US009383701B2

(12) United States Patent
Yanagida

(10) Patent No.: US 9,383,701 B2
(45) **Date of Patent: *Jul. 5, 2016**

(54) IMAGE FORMING APPARATUS, IMAGE FORMING APPARATUS CONTROL METHOD, AND STORAGE MEDIUM STORING IMAGE FORMING APPARATUS CONTROL PROGRAM

(71) Applicant: Yasushi Yanagida, Kanagawa (JP)

(72) Inventor: Yasushi Yanagida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/295,590

(22) Filed: Jun. 4, 2014

(65) Prior Publication Data

US 2014/0286669 A1 Sep. 25, 2014

Related U.S. Application Data

(62) Division of application No. 13/137,716, filed on Sep. 7, 2011, now Pat. No. 8,781,389.

(30) Foreign Application Priority Data

Sep. 13, 2010 (JP) ..... 2010-203864

(51) Int. Cl.
*G03G 15/00* (2006.01)
*B65H 29/00* (2006.01)
(Continued)

(52) U.S. Cl.
CPC ..... *G03G 15/5016* (2013.01); *B41J 13/106* (2013.01); *G03G 15/00* (2013.01)

(58) Field of Classification Search
CPC ... G03G 15/00; G03G 15/5016; B65H 29/00; B65H 31/00; B41J 13/106
USPC ..... 399/405
See application file for complete search history.

(56) References Cited

U.S. PATENT DOCUMENTS 5,905,520 A 5/1999 Fujii et al.
6,574,013 B1 6/2003 Koshi
(Continued)

FOREIGN PATENT DOCUMENTS

CN 1349138 A 5/2002
JP 08-165052 A 6/1996
(Continued)

OTHER PUBLICATIONS

Chinese Office Action dated Dec. 26, 2013.
(Continued)

*Primary Examiner* — Nguyen Ha
(74) *Attorney, Agent, or Firm* — Harness, Dickey & Pierce, P.L.C.

(57) ABSTRACT

An image forming apparatus includes a printing device to print images on sheets using a printing operation and to initiate a discharge of printed sheets from a sheet discharge port onto the discharge tray disposed for the image forming apparatus; a counter operatively connected to the printing device to count the number of printed sheets based on content of a print job; a controller to determine whether the number of printed sheets counted by the counter reaches a maximum sheet stacking capacity of the discharge tray, the maximum sheet stacking capacity being determined by a distance between the sheet discharge port and the discharge tray; and a reporting device to report that the discharge tray is full when the controller determines that the number of printed sheets counted by the counter reaches the maximum sheet stacking capacity.

15 Claims, 5 Drawing Sheets

(51) Int. Cl.
*B65H 31/00* (2006.01)
*B41J 13/10* (2006.01)

(56) References Cited

U.S. PATENT DOCUMENTS

| | | | | |
|---|---|---|---|---|
| 6,594,545 | B1 * | 7/2003 | Kakigi | H04N 1/00567 271/248 |
| 7,107,006 | B1 | 9/2006 | Sato et al. | |
| 8,781,389 | B2 * | 7/2014 | Yanagida | 399/405 |
| 2001/0053295 | A1 | 12/2001 | Kujirai et al. | |
| 2002/0044810 | A1 | 4/2002 | Sato et al. | |
| 2004/0008359 | A1 | 1/2004 | Christiansen | |
| 2004/0096254 | A1 | 5/2004 | Sato et al. | |
| 2005/0094175 | A1 | 5/2005 | Christiansen et al. | |
| 2006/0051147 | A1 | 3/2006 | Sato et al. | |
| 2006/0227356 | A1 | 10/2006 | Jeong et al. | |
| 2008/0088863 | A1 | 4/2008 | Suzuki | |
| 2009/0147310 | A1 | 6/2009 | Tsunekawa | |
| 2010/0044949 | A1 * | 2/2010 | Nakamura | B65H 29/60 271/3.17 |
| 2011/0128563 | A1 | 6/2011 | Rupe et al. | |

FOREIGN PATENT DOCUMENTS

| | | | | |
|---|---|---|---|---|
| JP | 2000238385 | A * | 9/2000 | B41J 29/38 |
| JP | 2001312396 | A | 11/2001 | |
| JP | 2003155163 | A * | 5/2003 | B65H 31/18 |
| JP | 2003-192225 | A | 7/2003 | |
| JP | 2006259998 | A | 9/2006 | |
| JP | 3938688 | B2 | 6/2007 | |
| JP | 2008281676 | A * | 11/2008 | G03G 15/00 |

OTHER PUBLICATIONS

English language abstract of Japanese Patent Publication 2003-192225.

* cited by examiner

IMAGE FORMING APPARATUS, IMAGE FORMING APPARATUS CONTROL METHOD, AND STORAGE MEDIUM STORING IMAGE FORMING APPARATUS CONTROL PROGRAM

CROSS-REFERENCE TO RELATED APPLICATIONS

This application is a divisional application of and claims priority under 35 U.S.C. §120/121 to U.S. application Ser. No. 13/137,716 filed Sep. 7, 2011, which claims priority under 35 U.S.C. §119 to Japanese Patent Application No. 2010-203864, filed on Sep. 13, 2010 in the Japan Patent Office, the contents of each of which is incorporated by reference herein its entirety.

BACKGROUND OF THE INVENTION

1. Field of the Invention

The present invention relates to an image forming apparatus, an image forming apparatus control method, and a storage medium storing an image forming apparatus control program to detect a full tray state of discharged sheets for the image forming apparatus while saving space and reducing cost of the image forming apparatus.

2. Description of the Background Art

When image forming apparatuses such as printers, copiers, and multi-functional image forming apparatuses print images on sheets of recording media such as paper, the printed sheets are discharged onto a discharge tray from a sheet discharge port and stacked on the discharge tray until a user retrieves the printed sheets from the discharge tray. Typically, the discharge tray is disposed below the sheet discharge port on the housing of the image forming apparatus, and has a given capacity. The sheet stacking capacity defines a limit on the number of sheets that can be stacked on the discharge tray without causing a problem of sheet discharge from the sheet discharge port. Specifically, if too many sheets are stacked on the discharge tray (i.e., if the sheet stacking capacity is exceeded), the stacked sheets may block the sheet discharge port, preventing the sheets from being discharged from the sheet discharge port and possibly causing sheet jamming at the sheet discharge port.

To prevent such sheet jamming, conventional configurations include a detector to detect a stacking condition of sheets on the discharge tray around the sheet discharge port, in which the detector detects whether the stacked sheets have reached a preset full sheet position. When the detector detects that the discharge tray is full, the printing operation is stopped temporarily.

However, the detector employs a physical mechanism such as a moving member and a sensor to detect movement of the moving member. Therefore, a space for the detector is required, incurring production and installation costs. As a result, if the detector is attached to a compact (i.e., slim) and cost-reduced image forming apparatus, both the bulk and cost of the apparatus increases.

JP-2003-192225-A employs a configuration having a filler that moves when sheets are discharged thereon, and a sensor to detect a position of the filler. Specifically, the filler can be moved to a lowest position depending on an amount of sheets on the discharge tray, and the sensor detects such position change of the filler. The position change of the filler is used both for detecting discharged sheets and detecting that the discharge tray is full.

The configuration described in JP-2003-192225-A has the advantage that it uses a single sensor to detect both the discharged-sheets and that the discharge tray is full, thus reducing both the space required for installing the sensor and the installation cost of the sensor. However, detection of both the discharged sheets and that the discharge tray is full increases the size of the filler, thus limiting the extent to which the space for installing the sensor and the installation cost can be reduced.

SUMMARY

In one aspect of the invention, an image forming apparatus is devised. The image forming apparatus includes a printing device to print images on sheets using a printing operation and to initiate a discharge of printed sheets from a sheet discharge port onto the discharge tray disposed for the image forming apparatus; a counter operatively connected to the printing device to count the number of printed sheets based on content of a print job; a controller to determine whether the number of printed sheets counted by the counter reaches a maximum sheet stacking capacity of the discharge tray, the maximum sheet stacking capacity being determined by a distance between the sheet discharge port and the discharge tray; and a reporting device to report that the discharge tray is full when the controller determines that the number of printed sheets counted by the counter reaches the maximum sheet stacking capacity.

In another aspect of the invention, a method of controlling an image forming operation for an image forming apparatus is devised. The method includes the steps of printing images on sheets using a printing process; discharging printed sheets from a sheet discharge port to a discharge tray disposed for the image forming apparatus; counting the number of printed sheets based on content of a print job; determining whether the number of printed sheets counted by the counter reaches a maximum sheet stacking capacity of the discharge tray, the maximum sheet stacking capacity being determined by a distance between the sheet discharge port and the discharge tray; and reporting that the discharge tray is full when the determining step determines that the counted numbers of printed sheets reaches the maximum sheet stacking capacity.

In another aspect of the invention, a computer-readable medium storing a program comprising instructions that when executed by a computer cause the computer to execute a method of controlling an image forming operation for an image forming apparatus is devised. The method includes the steps of printing images on sheets using a printing process; discharging printed sheets from a sheet discharge port to a discharge tray disposed for the image forming apparatus; counting the number of printed sheets based on content of a print job; determining whether the number of printed sheets counted by the counter reaches a maximum sheet stacking capacity of the discharge tray, the maximum sheet stacking capacity being determined by a distance between the sheet discharge port and the discharge tray; and reporting that the discharge tray is full when the determining step determines that the counted numbers of printed sheets reaches the maximum sheet stacking capacity.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
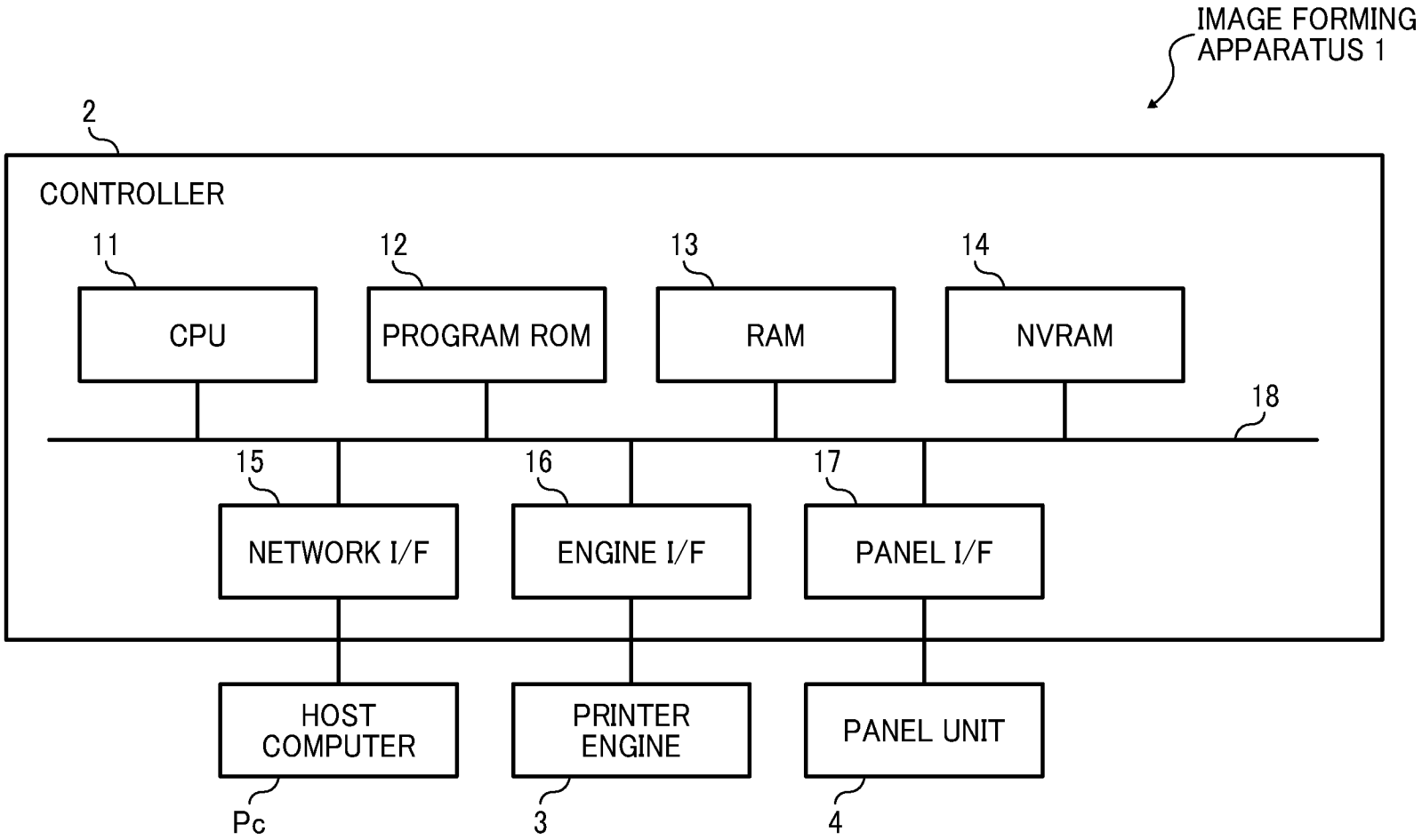
FIG. 1 shows a block diagram of image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner and achieve a similar result.

Referring now to the drawings, an apparatus and system, which can be used with a network, according to example embodiment is described hereinafter.

FIGS. 1 to 7 show an example of image forming apparatus, image forming control method, image forming control program and storage medium of program according to an example embodiment. FIG. 1 shows a block diagram of an image forming apparatus 1 according to an example embodiment, in which an image forming apparatus, an image forming control method, an image forming control program and a storage medium of program according to an example embodiment can be devised.

As shown in FIG. 1, the image forming apparatus 1 includes a controller 2, a printer engine 3, and a panel unit 4, or the like. The controller 2 includes a central processing unit (CPU) 11, a program read only memory (ROM) 12, a random access memory (RAM) 13, a nonvolatile random access memory (NVRAM) 14, a network interface (I/F) 15, an engine interface (I/F) 16, and a panel I/F 17, and such units are connected with each other via a bus 18. The controller 2 can be configured using various types of processors, circuits, or the like such as a programmed processor, a circuit, an application specific integrated circuit (ASIC), used singly or in combination.

The network I/F 15 is connected to a host computer Pc via a network such as a local area network (LAN). The network I/F 15 can function as an interface between the image forming apparatus 1 and the host computer Pc. Specifically, the network I/F 15 receives control signals and data (e.g., print data), transmitted from the host computer Pc, and transmits status signals or the like from the image forming apparatus 1 to the host computer Pc.

The program ROM 12 stores programs to control data processing/management in the controller 2 and programs to control peripheral modules. Specifically, the program ROM 12 stores basic programs to control the image forming apparatus 1, programs to execute an image forming control method when a full sheet is detected on the discharge tray, and various data required for executing such programs.

The CPU 11 (used as a counter to count the number of printed sheets and a controller) controls a printing process or operation by controlling each unit in the image forming apparatus 1 using a program stored in the program ROM 12 and using the RAM 13 as a working memory. Further, the CPU 11 controls an image forming control processing to control an image forming operation when a full condition of discharged sheets is detected, which will be described later.

The RAM 13 can be used as a working memory of the CPU 11, and the RAM 13 can be used as a bitmap memory. For example, print data received from the host computer Pc, is managed as page-by-page data and temporarily stored in a buffer, and data stored in the buffer is converted an actual print pattern data such as image-drawing data, and such data is stored as bitmap data in the RAM 13, used as a bitmap memory. The RAM 13 has a storage capacity to store data such as print data, image-drawing data converted from print data, or intermediary data for a plurality of pages.

The NVRAM 14 is used as a memory to store data when the power supply to the image forming apparatus 1 is set OFF. The NVRAM 14 stores data that need to be retained even if the image forming apparatus 1 is at the power-supply OFF condition. Specifically, under the control of the CPU 11, various setting information are stored in the NVRAM 14 such as system setting values, a count value of printed sheets numbers, print settings or the like, and various data and setting information used for controlling an image forming control processing when detecting a full sheet condition of discharged sheets.

The engine OF 16 is connected to the printer engine 3. The engine OF 16 can function as an interface between the controller 2 and the printer engine 3. Specifically, control signals and image-drawing data can be transmitted from the controller 2 to the printer engine 3, and status signals can be transmitted from the printer engine 3 to the controller 2.

The printer engine 3 (used as a printing device) may be a printer engine, for example, of image forming apparatus using electrophotography. The print data transmitted from the host computer Pc and received by the network OF 15 is converted to the image-drawing data, and then the image-drawing data is transmitted from the engine OF 16 to the printer engine 3. The printer engine 3 outputs images on sheets fed from a sheet feed unit, and then the printed sheets are discharged from the sheet discharge port to the discharge tray.

A maximum sheet stacking capacity on the discharge tray can be determined based on a positional relationship of the sheet discharge port and the discharge tray, and data of maximum sheet stacking capacity N (or maximum output capacity N) can be stored in a non-volatile memory of the printer engine 3 or the NVRAM 14.

The panel I/F 17 is connected to the panel unit 4, and the panel I/F 17 is used to communicate signals between the controller 2 and the panel unit 4.

The panel unit 4 (used as a reporting device, an instruction device, a count setting device) includes operation keys such as ten keys, a start key, mode selection keys, or the like, and a display device such as a liquid crystal display having a touch panel. Various commands and instructions such as printing operation instructions can be input by operating the operation keys and/or by touching the display device, and the display device can display commands and instructions input by the operation keys and various information of the image forming apparatus 1 to a user (information report function).

The host computer Pc may be a personal computer having a typical hardware configuration and software-implementing configuration. The host computer Pc can transmit print data prepared by using a page description language (PDL), and a control command described by using a printer job language (PJL) such as print control data to the image forming apparatus 1.

Further, the host computer Pc can transmit a PJL full-sheet-detection-function-setting command (or full-sheet-detection-function control command) to set ON/OFF of full-sheet-detection-function for the image forming apparatus 1 with the PDL print data using applications and/or a printer driver of the host computer Pc.

Figure 2:
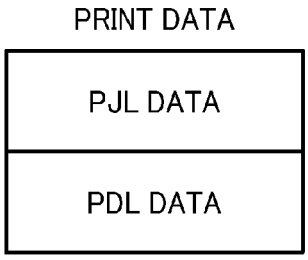
FIG. 2 shows a configuration of print data.

As such, the host computer Pc can generate or prepare print data composed of PJL data and PDL data, shown in FIG. 2, using the printer driver, and can transmit the print data to the image forming apparatus 1 via a network. Specifically, the host computer Pc transmits the PJL data added with a full-sheet-detection-function-setting command written by PJL to the image forming apparatus 1.

In the above-described example embodiment, a computer can be used with a computer-readable program, described by object-oriented programming languages such as C++, Java (registered trademark), JavaScript (registered trademark), Perl, Ruby, or legacy programming languages such as machine language, assembler language to control functional units used for the apparatus or system. For example, a particular computer (e.g., personal computer, work station) may control an information processing apparatus or an image processing apparatus such as image forming apparatus using a computer-readable program, which can execute the above-described processes or steps for the image forming control method using a detection of full sheet condition of discharged sheets. Further, in the above-described exemplary embodiment, a storage device (or recording medium) such as the program ROM 12, which can store computer-readable program, may be a flexible disk, a compact disk read only memory (CD-ROM), a digital versatile disk read only memory (DVD-ROM), DVD recording only/rewritable (DVD-R/RW), electrically erasable and programmable read only memory (EEPROM), erasable programmable read only memory (EPROM), a memory card or stick such as USB memory, a memory chip, a mini disk (MD), a magneto optical disc (MO), magnetic tape, hard disk in a server, or the like, but not limited these. Further, a computer-readable program can be downloaded to a particular computer (e.g., personal computer) via a network such as the internet, or a computer-readable program can be installed to a particular computer from the above-mentioned storage device, by which the particular computer may be used for the system or apparatus according to an example embodiment, for example.

Figure 3:
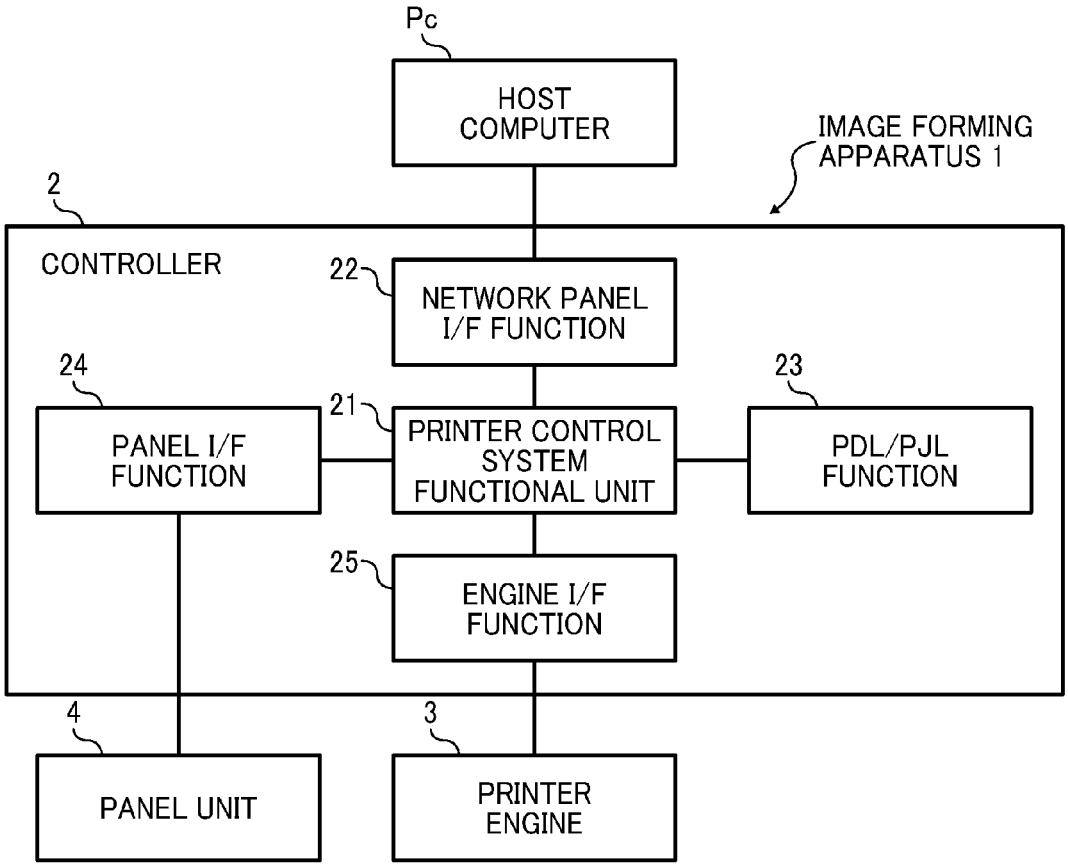
FIG. 3 shows a functional block diagram of controller.

When the above described image forming control program is installed and executed for the image forming apparatus 1, the controller 2 can be configured with a printer control system functional unit 21, a network panel I/F function 22, a PDL/PJL function 23, a panel I/F function 24, and an engine OF function 25 as shown in FIG. 3.

The network panel I/F function 22 receives control signals and data such as print data, transmitted from the host computer Pc, and then transfers the signals and data to the printer control system functional unit 21. Further, the network panel I/F function 22 receives status signals of the image forming apparatus 1 from the printer control system functional unit 21, and transmits the status signals to the host computer Pc.

The PDL/PJL function 23 receives print data to prepare image-drawing data, and then transfers the image-drawing data to the printer control system functional unit 21. Specifically, the PDL/PJL function 23 interprets PJL command and PDL command in print data transmitted from the host computer Pc, prepares the image-drawing data from the print data, and transfers the image-drawing data to the printer control system functional unit 21.

The panel I/F function 24 controls the panel unit 4 under the control of the printer control system functional unit 21.

The engine OF function 25 instructs a print instruction to the printer engine 3 under the control of the printer control system functional unit 21.

Figure 4:
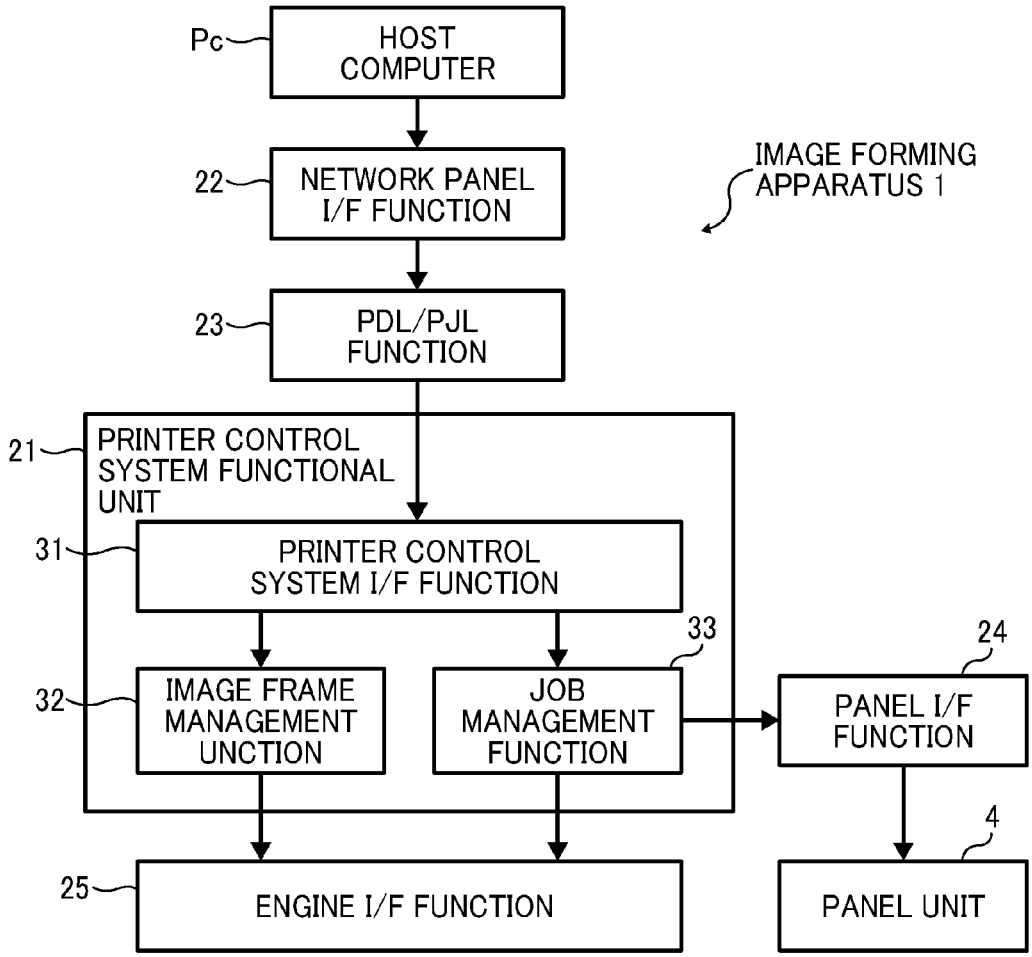
FIG. 4 shows a block diagram of printer control system.

The printer control system functional unit 21 includes a printer control system OF function 31, an image frame management function 32, and a job management function 33 as shown in FIG. 4.

The printer control system OF function 31 conducts an interface processing between the PDL/PJL function 23 and the image frame management function 32 or the job management function 33.

The image frame management function 32 conducts image management of print data for page-by-page data, and the image frame management function 32 may have an image memory to store and manage print data and image-drawing data transmitted from the PDL/PJL function 23 via the printer control system OF function 31.

Figure 5:
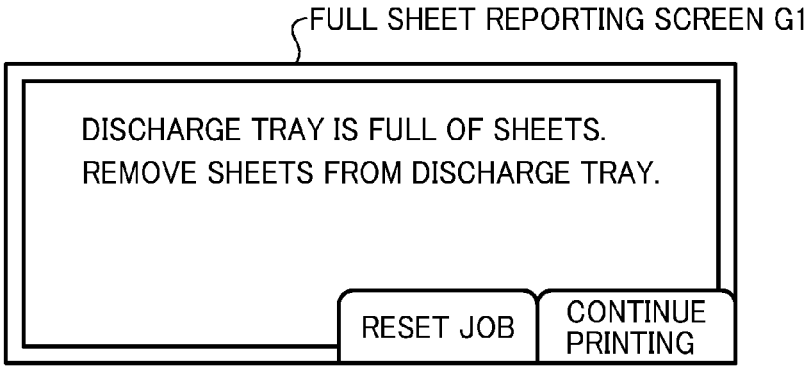
FIG. 5 shows an example screen of reporting a full sheet condition.

The job management function 33 conducts a job management of print data. Specifically, when the PJL full-sheet-detection-function-setting command designates the ON of full-sheet-detection-function, the sheet numbers processed by the printer engine 3 is counted based on PDL data. When the counted value reaches the maximum sheet stacking capacity N (or maximum output-able number N), set in advance, it is determined that the number of sheets on the discharge tray reaches the maximum sheet stacking capacity N (or maximum output-able number N). Then, it is instructed to stop a printing operation by the printer engine 3 via the engine OF function 25, and a full sheet reporting screen G1 (used as a reporting and instructing unit) may be displayed on the display device of the panel unit 4 via the panel I/F function 24 as shown in FIG. 5.

The job management function 33 displays a message on the full sheet reporting screen G1 reporting a full sheet condition such as "Discharge tray is full of sheets. Remove sheets from the discharge tray." Further, the full sheet reporting screen G1 displays a reset button, and a print continue button that can request a continuation of printing operation after removing sheets from the discharge tray. If a user retrieves sheets from the discharge tray and then operates the print continue button displayed on the full sheet reporting screen G1 of the panel unit 4, the printer engine 3 can resume and continue the printing operation.

A description is given of an effect of processing for the image forming apparatus 1, in which based on the content of print job and execution of print job, it is determined whether sheets stacking on the discharge tray reaches the maximum sheet stacking capacity N (maximum output-able number N) to control a print operation.

When the host computer Pc generates or prepares print data, the host computer Pc can set a full-sheet-detection-function using applications and/or printer driver of the host computer Pc, in which the full-sheet-detection-function is used to detect whether sheets stacked on the discharge tray reaches the maximum sheets stacking capacity N (or maximum output-able number N) when a print job using print data is executed.

When the full-sheet-detection-function is set, the printer driver generates or prepares a PJL full-sheet-detection-function-setting command to set the ON/OFF of full-sheet-detection-function for the image forming apparatus 1, and transmits the PJL full-sheet-detection-function-setting command to the image forming apparatus 1 with the PDL data of print data as a print job.

The PJL full-sheet-detection-function-setting command can be set, for example, as follows.

When the full-sheet-detection-function is set ON: @PJL SET PAPERFULLDETECT=ON.

When the full-sheet-detection-function is set OFF: @PJL SET PAPERFULLDETECT=OFF.

When the host computer Pc transmits a print job to the image forming apparatus 1, the network panel I/F function 22 receives the print job. Then, the PDL/PJL function 23 receives the print job via the printer control system functional unit 21. The PDL/PJL function 23 interprets print data (i.e., PDL and PJL data) of the print job.

The PDL/PJL function 23 obtains information in the image memory of the RAM 13 from the image frame management function 32 via the printer control system OF function 31, generates or prepares image-drawing data from the print data, and loads the image-drawing data on the image memory.

When the loading of one page data of the image-drawing data is completed (i.e., page end), the PDL/PJL function 23 transfers one page data of the image-drawing data to the printer engine 3 via the engine OF function 25, and then the printer engine 3 conducts a printing operation of one page.

As for the job management function 33, a PageStart command written by PDL means the start of one page, and a PageEnd command written by PDL means the end of one page. At the timing of PageStart, the job management function 33 starts to count the number of sheets as the number of discharged sheets.

The job management function 33 compares the maximum sheet stacking capacity N (or maximum output-able number N) of the discharge tray, which is a destination of discharged sheets, and a count value corresponding to the number of pages, being in processing. Based on a comparison result, the job management function 33 determines whether the count value (the numbers of discharged sheets) reaches the maximum sheet stacking capacity N (or maximum output-able number N), and also determines whether a printing operation is to be stopped.

The job management function 33 can obtain the maximum sheet stacking capacity N (or maximum output-able number N) as follows. If the maximum sheet stacking capacity N is stored in the NVRAM 14, the job management function 33 can obtain the maximum sheet stacking capacity N from the NVRAM 14. Further, if the maximum sheet stacking capacity N is stored in a non-volatile memory of the printer engine 3, the job management function 33 can request data of the maximum sheet stacking capacity N to the printer engine 3 via the engine OF function 25, and can obtain the maximum sheet stacking capacity N from the printer engine 3.

Specifically, when the current count value of sheets (i.e., accumulated printed-page numbers at current timing) equals the maximum sheet stacking capacity N (or maximum output-able number N), the job management function 33 determines that the numbers of sheets stacked on the discharge tray reaches the maximum sheet stacking capacity N (or maximum output-able number N), and instructs the printer engine 3 to stop a printing operation of a next page via the engine OF function 25.

When the job management function 33 stops a printing operation, the job management function 33 instructs the panel unit 4 to display the full sheet reporting screen G1 on the display device shown in FIG. 5 via the panel I/F function 24. The job management function 33 instructs the panel unit 4 to display a message of reporting a full sheet condition such as "Discharge tray is full of sheets. Remove sheets from the discharge tray." Further, the full sheet reporting screen G1 displays a reset button, and a print continue button that can request a continuation of printing operation after removing sheets from the discharge tray.

If a user removes or retrieves sheets from the discharge tray and then operates the print continue button displayed on the full sheet reporting screen G1 of the display device of the panel unit 4, the printer engine 3 can resume and continue the printing operation. Specifically, when the job management function 33 receives a command indicating that the print continue button on the full sheet reporting screen G1 is operated from the panel unit 4 via the panel I/F function 24, the job management function 33 instructs the printer engine 3 to start a printing operation of a next page via the engine OF function 25.

As such, as for the image forming apparatus 1, when printed sheets printed by the printer engine 3 are discharged from the sheet discharge port and stacked on the discharge tray, the job management function 33 counts the numbers of printed sheets based on the print job. Then, the job management function 33 determines whether the counted numbers of printed sheets reaches the maximum sheet stacking capacity N (or maximum output-able number N) set for the discharge tray, wherein the maximum sheet stacking capacity N (or maximum output-able number N) can be determined based on a distance or space between the sheet discharge port and the discharge tray. When the counted numbers of printed sheets reaches the maximum sheet stacking capacity N (or maximum output-able number N), the job management function 33 instructs the panel unit 4 to display a report of full sheet condition that sheets stacked on the discharge tray reaches the maximum sheet stacking capacity N (or maximum output-able number N).

Therefore, a full sheet condition on the discharge tray can be detected without disposing a detector to detect sheets on the discharge tray, and thereby a full sheet condition can be reported with a configuration of reduced cost and saving of space.

Further, as for the image forming apparatus 1, when the counted numbers of printed sheets reaches the maximum sheet stacking capacity N (or maximum output-able number N), the job management function 33 instructs the panel unit 4 to display the full sheet reporting screen G1 having the print continue button on the display device of the panel unit 4 as shown in FIG. 5, by which a full sheet condition on the discharge tray can be reported, and a printing operation conducted by the printer engine 3 is stopped. If a user retrieves or removes sheets from the discharge tray and then operates the print continue button displayed on the full sheet reporting screen G1 of the panel unit 4, the printer engine 3 can resume and continue the printing operation.

Therefore, when the full sheet condition on the discharge tray is detected, the full sheet condition is reported and the printing operation is stopped, by which sheet jamming near the sheet discharge port can be prevented. Further, if a user operates the print continue button, it is determined that sheets are removed from the discharge tray, and the printing operation can be resumed, and thereby user's convenience can be enhanced.

Further, when the image forming apparatus 1 receives the print job from the host computer Pc, the job management function 33 can count the numbers of printed sheets based on an interpretation result of PDL data in the print job.

Therefore, the numbers of printed sheets can be counted correctly based on the print job transmitted from an external apparatus such as host computer Pc, and thereby the full sheet detection can be conducted preferably.

Further, the host computer Pc can transmit the print job to the image forming apparatus 1 with PJL full-sheet-detection-function-setting command (or full-sheet-detection-function control command) to set the ON/OFF of full-sheet-detection-function for the image forming apparatus 1.

Based on the PJL sheet full-sheet-detection-function-setting command, which may be set by a user, the job management function 33 counts the numbers of printed sheets. Based on the counted numbers of printed sheets, the job management function 33 determines to execute or not to execute a reporting of full sheet condition.

Therefore, the full-sheet-detection-function can be set and conducted based on a need of user that transmits a print job to the image forming apparatus 1, by which user's convenience can be further enhanced.

Although the above described embodiment describes a case that one print job is conducted using print data for printing one set, but the above described embodiment can be applied when the image forming apparatus 1 prints a plurality of sets for one job.

Figure 6:
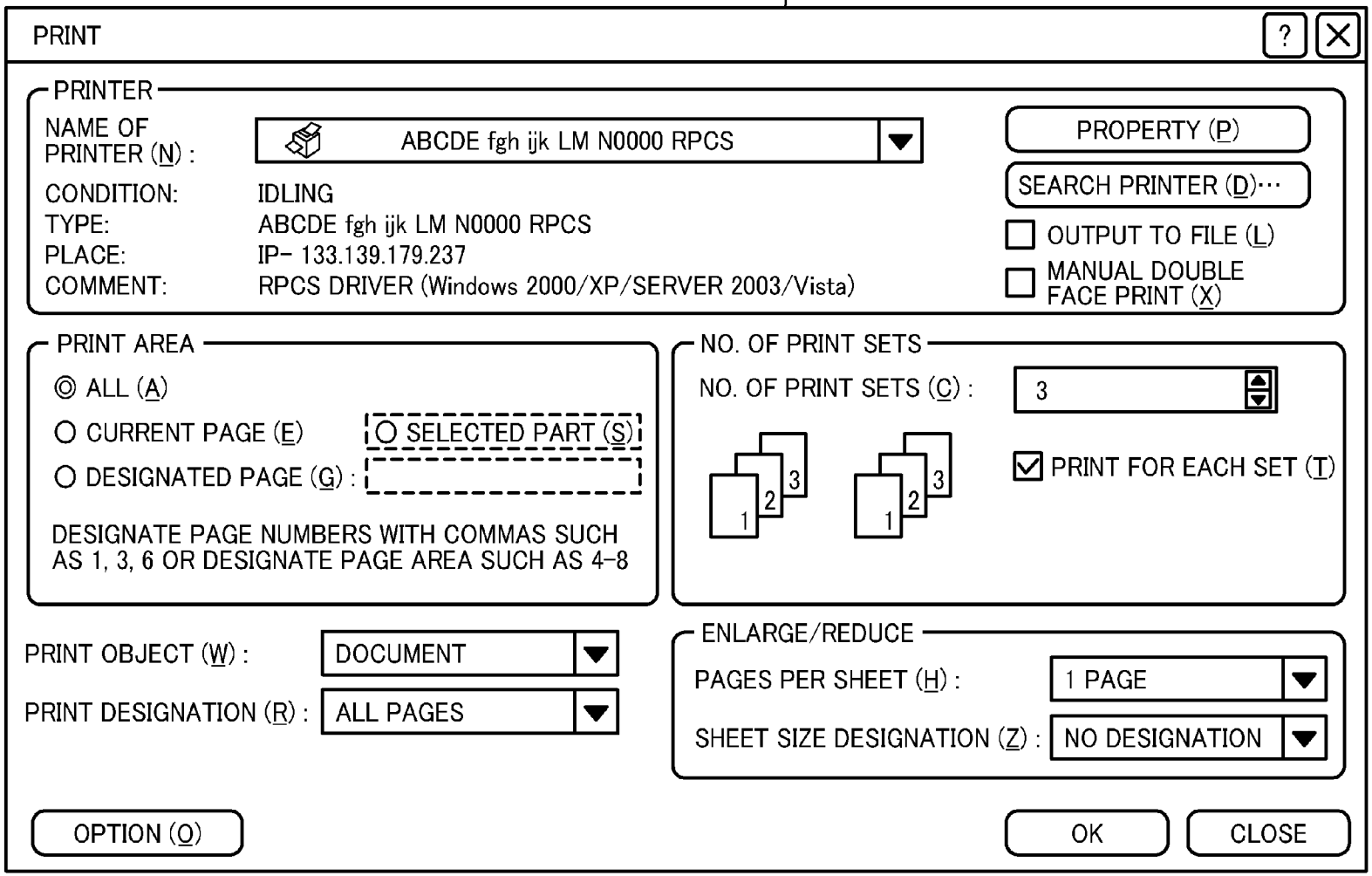
FIG. 6 shows an example of print setting screen.

A description is given of printing a plurality of sets for one job with reference to FIG. 6, in which "Windows" is a registered trademark. FIG. 6 shows a print setting screen G2 displayable on a display of the host computer Pc using a printer driver of the host computer Pc. For example, a user designates a plural number such as "3" as the number of print-sets and a check mark is input to a check box of "print for each set" (see FIG. 6). Then, a PJL command indicating that the number of print-sets is a plural number (e.g., 3) is generated or prepared.

When a PJL command such as @PJL SET QTY=3 is generated, the printer driver prepares a print job including one set of PDL print data and a PJL command designating the number of print-sets as "3," and transmits the print job to the image forming apparatus 1.

When the image forming apparatus 1 receives the print job designating the number of print-sets as "3" from the host computer Pc, the printing operation is to be conducted for a plurality of sets for one print job. Specifically, the PDL/PJL function 23 analyzes that the print job designates a plurality of sets for printing operation, and then print data is stored in an image memory or a hard disk. The image-drawing data is generated or prepared for the plurality of sets using the print data, and then transmitted to the printer engine 3, by which the print data can be printed for the plurality of sets such as three sets of printing operation.

In this case, the job management function 33 counts the numbers of printed sheets (or page numbers) corresponding to the plurality of sets at the above described count timing, and compares the counted numbers of printed sheets with the maximum sheet stacking capacity N (or maximum output-able number N), by which the job management function 33 can determine whether the number of sheets on the discharge tray reaches the maximum sheet stacking capacity N (or maximum output-able number N). Then, based on the determination result, a printing operation is controlled.

In such a configuration, when one print job is used to print a plurality of sets, a full sheet condition on the discharge tray can be detected without disposing a detector to detect sheets on the discharge tray, and thereby the full sheet condition on the discharge tray can be detected with a configuration of reduced cost and saving of space, and user's convenience can be enhanced with the reduced cost.

In the above described embodiment, an image forming control process is conducted using one print job, but the number of print job is not limited one. A description is given of an image forming control process when a plurality of print jobs is handled, in which it is determined whether the number of discharged and accumulated sheets reaches the maximum sheet stacking capacity N (or maximum output-able number N) as similar to the above described embodiment.

In this case, the image forming apparatus 1 displays one view on the display device of the panel unit 4. The view may be an initial setting view for the image forming apparatus 1, in which a setting section for a full sheet condition detection on the discharge tray is set, and the ON/OFF of full-sheet-detection-function on the discharge tray can be set using such setting section, in which the numbers of discharged sheets are counted and compared with the maximum sheet stacking capacity N (or maximum output-able number N) for the plurality of print jobs. In this configuration, a user can select and set the ON/OFF of full-sheet-detection-function on the discharge tray for the plurality of print jobs. Such full-sheet-detection-function conductable for a plurality of print jobs seamlessly may be referred to as "extended full-sheet-detection-function."

When the extended full-sheet-detection-function is set ON for a plurality of print jobs (e.g., first, second, third print job . . . ), the job management function 33 instructs a counter to count a count value of the numbers of discharged sheets for each job of the plurality of print jobs. Specifically, the job management function 33 instructs the counter to count and store the count value the NVRAM 14 for first print job without resetting the count value of printed sheets when a printing operation completes for the each job.

Before conducting a second print job, the count value for the first print job is read from the NVRAM 14. Then, when the second print job is conducted, the numbers of discharged sheets counted as a count value for the second print job is added to the count value for the first print job, by which the count value can be accumulated.

When such accumulated count value (i.e., the numbers of total discharged sheets) reaches the maximum sheet stacking capacity N (or maximum output-able number N), the job management function 33 stops the printing operation and displays the full sheet reporting screen G1. After removing sheets from the discharge tray and operating the print continue button on the full sheet reporting screen G1, the job management function 33 resumes the printing operation.

With such a configuration, sheets discharged on the discharge tray can be counted seamlessly for a plurality of print jobs, and the full sheet detection on the discharge tray can be conducted with a configuration of reduced cost and saving of space. As such, the full sheet detection can be conducted effectively, by which sheet jamming near the sheet discharge port can be prevented, and thereby user's convenience can be enhanced with a configuration of reduced cost and saving of space.

In the above described embodiments, an image of one page is printed on one face of sheet, but the above described embodiments can be applied for a duplex printing and a page-combined printing.

A duplex printing is conducted by preparing an image-drawing data using print data of two pages, and printing print data of two pages using both faces of one sheet. Specifically, a print data of one page is printed on one face of the sheet, and a print data of another one page is printed on another face of the sheet. Then, the job management function 33 instructs a counter, used for counting the numbers of discharged sheets, to increase a count value for "one" when print data of two pages is printed on one sheet.

Further, a page-combined printing is conducted by printing a plurality of pages on one face by combining the plurality of pages on one face, in which the job management function 33 instructs a counter, used for counting the numbers of discharged sheets, to increase a count value in view of the number of combined pages.

For example, when two pages are combined as one page to print two pages data on one page, the job management function 33 prepares an image-drawing data for one page using print data of two pages, and then the job management function 33 instructs a counter, used for counting the numbers of discharged sheets, to increase a count value for "one" when print data of two pages is printed on one face of one sheet.

For example, when four pages are combined as one page to print four pages data on one page, the job management function 33 prepares an image-drawing data for one page using print data of four pages, and then the job management function 33 instructs a counter, used for counting the numbers of discharged sheets, to increase a count value for "one" when print data of four pages is printed on one face of one sheet.

As such, as for the duplex printing and page-combined printing, a full sheet condition on the discharge tray can be detected without disposing a detector to detect sheets on the discharge tray, and a full sheet condition can be reported with a configuration of reduced cost and saving of space, and thereby user's convenience can be enhanced.

Figure 7:
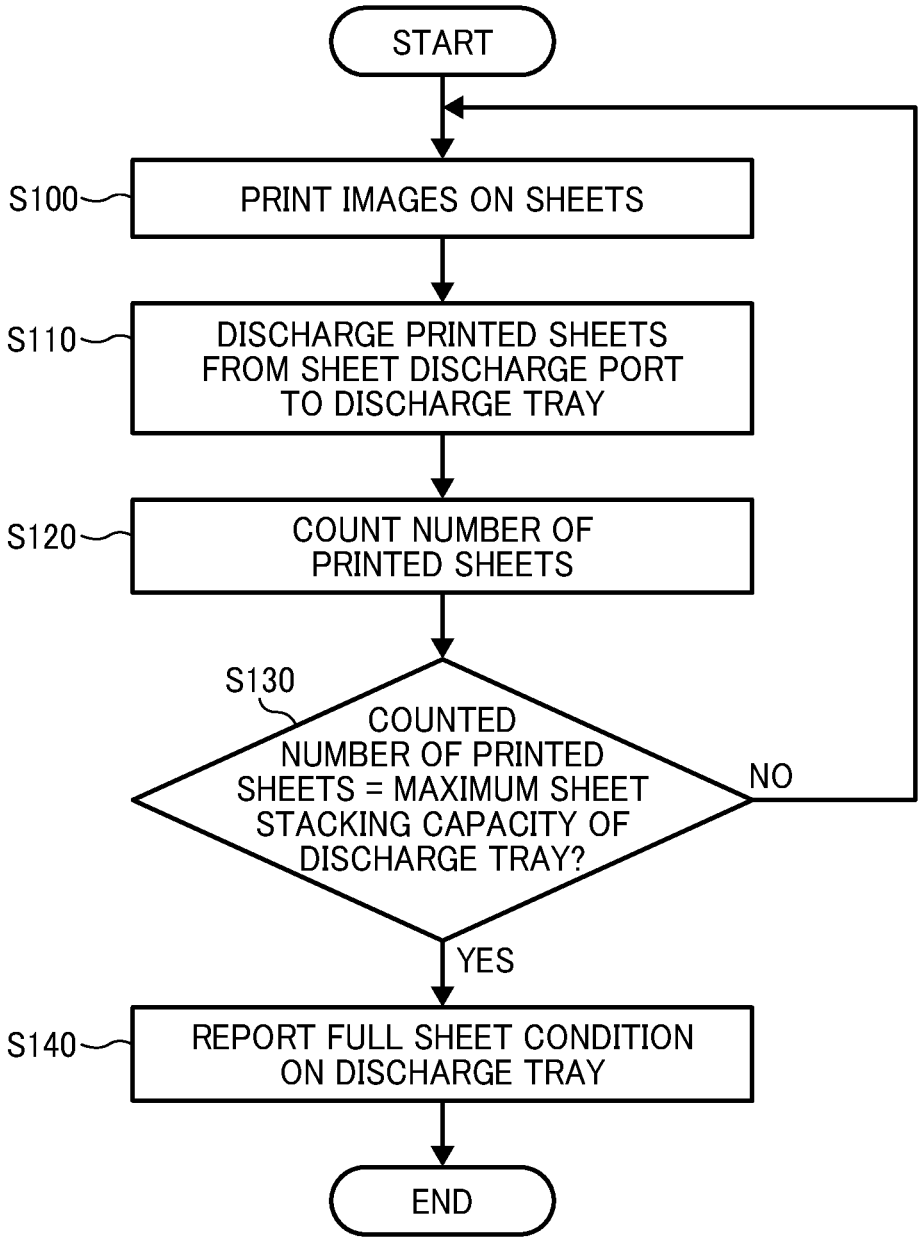
FIG. 7 is a flowchart showing steps in a process of detecting a full sheet condition on the discharge tray according to an example embodiment.

A description is now given of process of controlling an image forming operation for an image forming apparatus in view of the number of sheets discharged from an image forming apparatus with reference to FIG. 7. FIG. 7 shows a flowchart of steps in a process of detecting a full sheet condition on the discharge tray according to an example embodiment.

At step S100, an image forming operation to print images on sheets is conducted using one or more print jobs. At step S110, the printed sheets are discharged from a sheet discharge port to a discharge tray disposed for the image forming apparatus. At step S120, the number of printed sheets is counted by the counter in view of content of the print job. At step S130, it is determined whether the number of printed sheets counted by the counter equals a maximum sheet stacking capacity of the discharge tray. The maximum sheet stacking capacity can be determined from a distance between the sheet discharge port and the discharge tray. If the determining step determines that the counted number of printed sheets is less than the maximum sheet stacking capacity (S130: NO), the process returns to step S100. If the determining step determines that the counted number of printed sheets equals the maximum sheet stacking capacity (S130: YES), a full sheet condition on the discharge tray is reported by displaying a message on the full sheet reporting screen G1 as shown in FIG. 5 at step S140. If a user retrieves or removes sheets from the discharge tray and then operates the print continue button displayed on the full sheet reporting screen G1 of the panel unit 4, the printing operation can be resumed.

The present invention can be applied to an image forming apparatus, image forming control method, image forming control program, and storage medium of program in which a full sheet condition on the discharge tray can be detected without disposing a detector.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a panel;

a tray;

a printing device configured to eject a sheet to the tray; and a control device configured to, receive an input by a user, count a number of sheets ejected by the printing device without using a sensor, the control device being configured to instruct the panel to display a sheet full condition and prevent the printing device from ejecting a subsequent sheet if the counted sheet number becomes a given number, and the control device is configured to instruct the printing device to eject the subsequent sheet to the tray if the control device receives a print continue instruction by the user via the panel after the panel displays the sheet full condition, receive a print job including an instruction, the instruction indicating a sheet full condition detection status, and count the number of sheets ejected by the printing device based on the received instruction.

2. The image forming apparatus of claim 1, wherein the control device is configured to instruct the panel to display the sheet full condition and prevent the printing device from ejecting the subsequent sheet during printing, and the control device is configured to resume the printing if the instruction device receives the print continue instruction by the user.

3. The image forming apparatus of claim 1, wherein the print job includes page description data and printer job data, the instruction being in the printer job data.

4. The image forming apparatus of claim 3, wherein the control device is configured to count the number of sheets ejected by the printing device based on the page description data.

5. The image forming apparatus of claim 1, further comprising:

a sheet discharge port, wherein the given number is based on a positional relationship of the sheet discharge port and the tray.

6. The image forming apparatus of claim 1, wherein the control device is configured to, set the counting for a plurality of print jobs, and at least one of (1) count the number of sheets ejected by the printing device for each one of the plurality of print jobs based on a setting, and (2) count the number of sheets ejected by the printing device for all of the plurality of print jobs based on the setting.

7. The image forming apparatus of claim 1, wherein the control device is configured to, instruct the panel to display the sheet full condition requesting sheet removal, instruct the panel to display a print continue button, and control the printing device to eject the sheet if the print continue button is selected.

8. The image forming apparatus of claim 1, further comprising:

a memory configured to store a capacity associated with the tray, the capacity representing a number of sheets the tray is configured to hold, the control device being configured to prevent the printing device from ejecting the subsequent sheet if the counted sheet number is the stored capacity.

9. An image forming apparatus, comprising:

a tray;

a panel;

a printing device configured to eject a sheet to the tray; and a control device configured to, receive an input by a user, count a number of sheets ejected by the printing device without using a sensor, and to determine whether the counted sheet number becomes a given number, instruct the panel to display a sheet full condition and prevent the printing device from ejecting a subsequent sheet to the tray if the sheet number becomes the given number, and the control device is configured to resume printing if the control device receives a print continue instruction by the user via the panel after the panel displays the sheet full condition, receive a print job including an instruction, the instruction indicating a sheet full condition detection status, and count the number of sheets ejected by the printing device based on the received instruction.

10. The image forming apparatus of claim 9, wherein the control device is configured to instruct the panel to display the sheet full condition and prevent the printing device from ejecting the subsequent sheet during printing.

11. The image forming apparatus of claim 9, wherein the print job includes page description data and printer job data, the instruction being in the printer job data.

12. The image forming apparatus of claim 11, wherein the control device is configured to count the number of sheets ejected by the printing device based on the page description data.

13. The image forming apparatus of claim 9, further comprising:

a sheet discharge port, wherein the given number is based on a positional relationship of the sheet discharge port and the tray.

14. The image forming apparatus of claim 9, wherein the control device is configured to, set the counting for a plurality of print jobs, and at least one of (1) count the number of sheets ejected by the printing device for each one of the plurality of print jobs based on a setting, and (2) count the number of sheets ejected by the printing device for all of the plurality of print jobs based on the setting.

15. A method of operating an image forming apparatus, the method comprising:

performing a printing operation including printing at least one sheet;

ejecting the at least one printed sheet to a tray;

receiving a print job including an instruction, the instruction indicating a sheet full condition detection status;

counting a number of the at least one printed sheet without using a sensor based on the received instruction;

displaying a sheet full condition and stopping the printing operation if the counted number becomes a given number; and resuming the printing operation if a print continue instruction is received from a user based on the stopping the printing operation.

* * * * *